US011708624B2

(12) United States Patent
Larker

(10) Patent No.: US 11,708,624 B2
(45) Date of Patent: Jul. 25, 2023

(54) METHOD FOR PRODUCING AN AUSFERRITIC STEEL, AUSTEMPERED DURING CONTINUOUS COOLING FOLLOWED BY ANNEALING

(71) Applicant: Ausferritic AB, Vindeln (SE)

(72) Inventor: Richard Larker, Vindeln (SE)

(73) Assignee: Ausferritic AB

( * ) Notice: Subject to any disclaimer, the term of this patent is extended or adjusted under 35 U.S.C. 154(b) by 222 days.

(21) Appl. No.: 16/571,531

(22) Filed: Sep. 16, 2019

(65) Prior Publication Data

US 2020/0087753 A1 Mar. 19, 2020

(30) Foreign Application Priority Data

Sep. 14, 2018 (SE) ..... 1851085-9
Dec. 11, 2018 (SE) ..... 1851553-6

(51) Int. Cl.
*C21D 9/52* (2006.01)
*C21D 6/00* (2006.01)
(Continued)

(52) U.S. Cl.
CPC ..... *C21D 9/525* (2013.01); *C21D 6/002* (2013.01); *C21D 6/005* (2013.01); *C21D 6/008* (2013.01);
(Continued)

(58) Field of Classification Search
CPC ..... C21D 9/525; C21D 6/002; C21D 6/005; C21D 6/008; C21D 8/1222; C21D 8/1261;
(Continued)

(56) References Cited

U.S. PATENT DOCUMENTS 6,203,634 B1 3/2001 Volkmuth
6,843,867 B1 1/2005 Foerster et al.
(Continued)

FOREIGN PATENT DOCUMENTS

CN 108384928 A 8/2018
CN 108977631 A 12/2018
(Continued)

OTHER PUBLICATIONS

Larrin ("How Fast Do You Have to Quench? Hardenability of Steel", Feb. 2019) (Year: 2019).*
(Continued)

*Primary Examiner* — Robert S Jones, Jr.
*Assistant Examiner* — Jiangtian Xu
(74) *Attorney, Agent, or Firm* — Lerner David LLP

(57) ABSTRACT

A method for producing an austempered steel is provided. The method includes subjecting a steel alloy having a silicon content of 1.5 to 4.4 weight percent and a carbon content of 0.3 to 0.8 weight percent to continuous cooling followed by annealing. The cooling rate is initially sufficiently fast to prevent predominant formation of proeutectoid ferrite or pearlite, while subsequently at intermediate temperatures, the cooling rate is sufficiently slow to allow a transformation of the austenite to mainly ausferrite during cooling. The annealing is able to complete the transformation of carbon enriched austenite to ausferrite and to temper any martensite previously formed. The method results in the cost-efficient production of one or more continuously cooled and annealed austempered steel components or semi-finished products having mainly an ausferritic microstructure.

6 Claims, 3 Drawing Sheets

(51) Int. Cl.

| | |
|---|---|
| ***C21D 8/12*** | (2006.01) |
| ***C22C 38/00*** | (2006.01) |
| ***C22C 38/02*** | (2006.01) |
| ***C22C 38/04*** | (2006.01) |
| ***C22C 38/42*** | (2006.01) |
| ***C22C 38/44*** | (2006.01) |
| ***C22C 38/46*** | (2006.01) |

(52) U.S. Cl.
CPC ..... *C21D 8/1222* (2013.01); *C21D 8/1261* (2013.01); *C22C 38/002* (2013.01); *C22C 38/02* (2013.01); *C22C 38/04* (2013.01); *C22C 38/42* (2013.01); *C22C 38/44* (2013.01); *C22C 38/46* (2013.01); *C21D 2211/001* (2013.01); *C21D 2211/005* (2013.01); *C21D 2211/008* (2013.01)

(58) Field of Classification Search
CPC ..... C21D 2211/001; C21D 2211/005; C21D 2211/008; C22C 38/002; C22C 38/02; C22C 38/04; C22C 38/42; C22C 38/44; C22C 38/46
See application file for complete search history.

(56) References Cited

U.S. PATENT DOCUMENTS

| | | | | |
|---|---|---|---|---|
| 2015/0267282 | A1 | 9/2015 | Schaffnit et al. | |
| 2016/0000764 | A1 | 1/2016 | Weinstabl et al. | |
| 2017/0233841 | A1* | 8/2017 | Larker ..... | C21D 5/00 420/108 |
| 2019/0144979 | A1 | 5/2019 | Zhang et al. | |

FOREIGN PATENT DOCUMENTS

| | | | |
|---|---|---|---|
| EP | 2982769 | A1 | 2/2016 |
| EP | 3177744 | A1 | 6/2017 |
| JP | S61174358 | A | 8/1986 |
| JP | S63199847 | A | 8/1988 |
| JP | S63241139 | A | 10/1988 |
| JP | H09296214 | A | 11/1997 |
| JP | 2017526823 | A | 9/2017 |
| JP | 2017527532 | A | 9/2017 |
| KR | 20040057262 | A | 7/2004 |
| KR | 20170041210 | A | 4/2017 |
| WO | 96/22396 | A1 | 7/1996 |
| WO | 2008076051 | A1 | 6/2008 |
| WO | 2009075494 | A1 | 6/2009 |
| WO | 2013149657 | A1 | 10/2013 |
| WO | 2016022054 | A1 | 2/2016 |
| WO | 2018006843 | A1 | 1/2018 |

OTHER PUBLICATIONS

Swedish Search Report for Application No. 1851085-9 dated Mar. 19, 2019.
Swedish Search Report for Application No. 1851553-6 dated Mar. 19, 2019.
European Search Report with Written Opinion for Application No. 19197349.4 dated Feb. 12, 2020, 9 pages.
Yoshiyuki, et al., "Effect of microstructure on transformation-induced plasticity of silicon-containing low-alloy steel," Materials Characterization, Apr. 1, 1997, pp. 243-250, vol. 38, No. 4-5.
Kim et al., Microstructure and Mechanical Properties of Austempered Medium-Carbon Spring Steel, Metals and Materials International, Published online Mar. 2018, pp. 693-701, vol. 24.
Krauss, Heat treatment and processing principles, ASM International, 2000, p. 267, ISBN 0-87170-370.
Larker et al., Ausferritic steels formed by continuous cooling or short isothermal cycles, followed by baking in air, EUROMAT 2019 E-poster ID 14511 in Symposium B1, Sep. 2019, 1 page, Stocklholm.
Li et al., Microstructure and mechanical properties of austempered high silicon cast steel, Materials Science and Engineering, Jun. 2001, pp. 277-282, vol. A308.
Papadimitriou et al., Kinetic and Thermodynamic Aspects of Bainitic Reactions in a Silicon Steel, Materials Research Society Symposia Proceedings, 1983, pp. 747-774, vol. 21.

* cited by examiner a) b)

a) b)

a) b)

a) b)

METHOD FOR PRODUCING AN AUSFERRITIC STEEL, AUSTEMPERED DURING CONTINUOUS COOLING FOLLOWED BY ANNEALING

CROSS-REFERENCE TO RELATED APPLICATIONS

The present application claims priority to Swedish Application No. 1851085-9 filed on Sep. 14, 2018 and Swedish Application No. 1851553-6 filed on Dec. 11, 2018, the disclosures of which are herein incorporated in their entirety by reference.

TECHNICAL FIELD

The present invention concerns a method for producing a predominantly ausferritic steel austempered during continuous cooling followed by annealing in an oven after casting, forging or rolling, said steel being suitable for cost-efficient production of components requiring high or very high strength and high or very high ductility and/or fracture toughness, wherein the silicon content in the alloy is increased to prevent bainite formation and promote a predominantly ausferritic (which has also been described as "carbide-free bainitic", "nanobainitic" or "superbainitic" in the prior art) microstructure during austempering also when formation is accomplished close above the initial $M_s$ temperature, and to increase the solid solution strengthening by silicon and carbon of the resulting acicular ferrite.

BACKGROUND OF THE INVENTION

In a typical austempering heat treatment cycle, work pieces comprising steel or cast iron are firstly heated and then held at an austenitizing temperature in a furnace until they become austenitic and the carbon from dissolved prior cementite in pearlite is evenly distributed in the austenite formed. In steel alloys the carbon content is fixed in prior production steps, while in cast irons the carbon content in the steel-like matrix between the dispersed graphite can be varied by the selection of the austenitization temperature during heat treatment, since the solubility of carbon in austenite increases with temperature and carbon can readily diffuse between matrix and graphite. In cast irons, the austenite must therefore be given enough time to be saturated with carbon diffusing from the graphite, especially if the matrix is partly ferritic or fully ferritic at ambient temperature.

After the work pieces are fully austenitized, they are quenched (usually in a salt bath) at a quenching rate that is high enough to avoid the formation of pearlite or proeutectoid ferrite during quenching down to an intermediate temperature below the pearlite region in the continuous cooling transformation (CCT) diagram but above the initial $M_s$ temperature, at which the austenite having this level of carbon would otherwise start to transform into martensite. This intermediate temperature austempering range is better known as the bainitic range for common low-silicon steels. The work pieces are then held for a time sufficient for a usually isothermal transformation to ausferrite at this temperature called "austempering" temperature, after which they are allowed to cool to ambient temperature.

In a similar way to the bainitic structures formed by similar heat treatments of low-silicon steels, final microstructure and properties of ausferritic materials are strongly influenced by the austempering temperature and holding time at that temperature. The ausferritic microstructure becomes coarser at higher transformation temperatures and finer at lower temperatures. In contrast to bainitic structures formed in low-silicon steels, nucleation and growth of acicular or feathery ferrite (depending on formation temperature) are generally not accompanied by formation of bainitic carbides, since this is delayed or prevented by the higher silicon content. Instead, the partial diffusion of carbon leaving the ferrite formed enriches the surrounding austenite, stabilizing it by reducing its $M_s$ far below ambient temperature. The resulting duplex matrix microstructure is named "ausferrite", consisting of acicular or feathery ferrite being nucleated and grown within concurrently carbon stabilized austenite.

At higher isothermal transformation temperatures, the coarser and mainly feathery ferrite is nucleated and grown in a matrix of relatively thick films of carbon stabilized austenite with a larger relative amount of austenite (which may promote higher ductility if the austenite is sufficiently stabilized with carbon), while at lower isothermal transformation temperatures, the increasingly fine and increasingly acicular ferrite is nucleated and grown in a matrix of relatively thin films of carbon stabilized austenite with a larger relative amount of ferrite (enabling higher strength).

Austempered ductile iron (ADI) (sometimes erroneously referred to as "bainitic ductile iron" even though when correctly heat treated, ADI contains no bainite) represents a special family of ductile (spheroidal graphite) cast iron alloys which possess improved strength and ductility properties. Compared to as-cast ductile irons, ADI castings are at least twice as strong at the same ductility level, or show at least twice the ductility at the same strength level.

In most cast irons including ductile irons, silicon levels of at least two weight percent in the ternary Fe—C—Si system are necessary to promote grey solidification resulting in graphite inclusions. When austempered, the increased silicon level further delays or completely prevents the formation of embrittling bainite (ferrite+cementite $Fe_3C$) during austempering, as long as the austempering temperature is relatively far above the $M_s$ temperature and the austempering time is not too prolonged. This freedom of bainitic carbides in "upper ausferrite" results in ductile properties (while in low-silicon steels "upper bainite" obtained at similar temperatures is brittle due to the location of its carbides). When austempering of conventional ductile irons is performed at low temperatures, their silicon contents of about 2.3-2.7 weight percent are not sufficient to completely prevent the formation of bainitic carbides in "lower ausferrite". Such microstructures contain fine acicular ferrite as their major phase, thin carbon stabilized austenite as well as some bainitic carbide, resulting in considerable decrease in ductility, fatigue strength and machinability.

Recently, as-cast ductile iron grades with silicon contents higher than 3 weight percent have been standardized, where their matrices are completely ferritic with increasing solid solution strengthening of the ferrite, providing concurrently increased yield strength and ductility compared to conventional ferritic-pearlitic ductile irons of the same ultimate tensile strength levels (450-600 MPa).

Such solution strengthened ductile irons have recently been used as precursors for austempering in development of the SiSSADI™ (Silicon Solution Strengthened ADI) concept by the present inventor. In order to obtain complete austenitization, higher temperatures are necessary (since the austenite field in the phase diagram shrinks with increasing silicon); otherwise any remaining proeutectoid ferrite both reduces the hardenability during quench (since nucleation of pearlite in austenite only is slow but growth of pearlite on any remaining proeutectoid ferrite is rapid) and reduces the resulting mechanical properties (since less ausferrite can be formed).

Benefits from increased silicon include shorter time both during austenitization (since carbon diffusion increases rapidly with increasing temperature) and during austempering (since silicon promotes the precipitation of ferrite), increased solution strengthening of the acicular ferrite (by both silicon and carbon), freedom of bainitic carbides also in "lower ausferrite" formed close above initial $M_s$, and as a result concurrently improved strength and ductility.

Ausferritic steels can be obtained by similar heat treatments as for ausferritic irons, on condition that the steels contain sufficient silicon to reduce or prevent the precipitation of bainitic carbides. An example of rolled commercial steels that are suitable for austempering to form ausferrite (without or with low contents of bainitic carbides) instead of bainite is the spring steel EN 1.5026 with a typical composition containing 0.55 weight percent carbon, 1.8 weight percent silicon and 0.8 weight percent manganese. When steels with sufficiently high silicon contents are austempered, they have usually been described as "carbide-free bainite", "nanobainite" or "superbainite", implying that the major part of the carbon leaving the formed ferrite is enriching and stabilizing the surrounding austenite instead of forming bainitic carbides.

International publication WO 2016/022054 by the present inventor describes austempered steel from the development of the SiSSASteel™ (Silicon Solution Strengthened Ausferritic Steel) concept for components requiring high strength and high ductility and/or fracture toughness, which has a silicon content of 3.1 weight percent to 4.4 weight percent and a carbon content of 0.4 weight percent to 0.6 weight percent and a microstructure that is ausferritic. A method for producing such an austempered steel is also disclosed. The method comprises the step of conducting an austempering heat treatment including complete austenitization, whereby the higher the silicon content of the steel, the higher the austenitization temperature.

For example, the austempered steel may be produced by forming a melt comprising steel with a silicon content of 3.1 to 4.4 weight percent and a carbon content of 0.4 to 0.6 weight percent, casting from the melt a component or a semi-finished bar, allowing the component or semi-finished bar to be forged or rolled before cooling or to cool directly, optionally followed by forging and subsequent cooling, then heat treating the cooled component, semi-finished bar or forging at a first temperature and holding the component, semi-finished bar or forging at the temperature for a predetermined time to completely austenitize the component, semi-finished bar or forging, quenching the heat treated component, semi-finished bar or forging at a quenching rate sufficient to prevent the formation of pearlite during quenching down to an intermediate temperature below the pearlite region in the continuous cooling transformation (CCT) diagram but above the $M_s$ temperature, such as a quenching rate of at least 150° C./min, heat treating the component, semi-finished bar or forging at one or several temperatures above the $M_s$ temperature for a predetermined time to austemper said component, semi-finished bar or forging, resulting in an ausferritic steel.

International publication WO 96/22396 discloses a method of producing a wear and rolling contact fatigue resistant bainitic steel product, whose microstructure is essentially carbide-free. The method comprises the steps of hot rolling a steel whose composition by weight includes from 0.05 to 0.50 weight percent carbon, from 1.00 to 3.00 weight percent silicon and/or aluminium, from 0.50 to 2.50 weight percent manganese, and from 0.25 to 2.50 weight percent chromium, balance iron and incidental impurities, and continuously cooling the steel from its rolling temperature naturally in air or by accelerated cooling.

It is disclosed that the carbon content of preferred steel compositions is 0.10 to 0.35 percent by weight and the silicon content of preferred steel compositions is 1.00 to 2.50 percent by weight. The resulting microstructure after cooling rates between 225° C./s and 2° C./s is essentially ausferritic (but described as "carbide-free bainitic"), with a small amount of soft proeutectoid ferrite as well as some high carbon martensite.

SUMMARY OF THE INVENTION

An object of the present invention is to provide an improved method for cost-efficient production of ausferritic steels that are austempered during continuous cooling from the fully austenitic state followed by annealing in an oven at one or more temperatures after either casting of one or more steel components, or after hot forging or after hot rolling of one or more semi-finished steel products.

This object is achieved by a method for producing an austempered steel, which comprises the steps of subjecting a steel alloy having a silicon content of 1.5 to 4.4 weight percent and a carbon content of 0.3 to 0.8 weight percent to continuous cooling followed by annealing. The continuous cooling begins from a fully austenitic temperature that is achieved as a result of casting of one or more steel components, or hot forging or hot rolling of one or more semi-finished steel products, whereby the cooling rate during the continuous cooling is initially sufficiently fast to prevent predominant formation of proeutectoid ferrite or pearlite, while subsequently at intermediate temperatures, the cooling rate is sufficiently slow to allow a transformation of the austenite to mainly ausferrite during cooling, before the austenite being enriched in carbon during growth of acicular ferrite has reached a temperature below its continuously decreasing $M_s$ temperature, thereby limiting the amount of martensite being formed if cooled to ambient temperature or lower, and where the annealing is able to complete the transformation of carbon enriched austenite to ausferrite and to temper any martensite previously formed, the method resulting in the production of one or more continuously cooled and annealed austempered steel components or semi-finished products having mainly an ausferritic microstructure.

It should be noted that the word "annealing" as used in this document is intended to mean a heat treatment in the temperature range below formation of proeutectoid ferrite or pearlite but above the $M_s$ temperature of the remaining austenite areas having the lowest carbon content after the establishment of a predominantly ausferritic microstructure during the preceding continuous cooling, thereby completing its transformation into ausferrite.

According to an embodiment of the invention the continuous cooling comprises cooling naturally in air and/or accelerated cooling and/or decelerated cooling in different temperature ranges.

According to an embodiment of the invention the austempered steel has a microstructure that contains less than 10 volume percent of proeutectoid ferrite.

According to an embodiment of the invention the austempered steel has a microstructure that contains less than 40 volume percent of tempered martensite, or less than 30 volume percent of tempered martensite, or less than 20 volume percent of tempered martensite or less than 10 volume percent of tempered martensite.

According to an embodiment of the invention the austempered steel is suitable for components requiring high strength and high ductility and/or fracture toughness.

According to an embodiment of the invention the austempered steel has a silicon content of 3.1 to 4.4 weight percent and a carbon content of 0.4 to 0.6 weight percent.

The method namely comprises the steps of subjecting a steel alloy having a silicon content of 1.5 to 4.4 weight percent and a carbon content of 0.3 to 0.8 weight percent to continuous cooling from the fully austenitic state that is achieved as a result of either casting of one or more steel components, of hot forging or of hot rolling of one or more 35 semi-finished steel products, whereby the cooling rate during said continuous cooling is initially sufficiently fast to prevent predominant (i.e. at least 50%) formation of proeutectoid ferrite and/or pearlite, while subsequently at intermediate austempering temperatures, the cooling rate is sufficiently slow to allow a transformation of the austenite to mainly ausferrite during cooling, before the austenite being enriched in carbon during growth of acicular ferrite has reached a temperature below its continuously decreasing $M_s$ temperature, thereby limiting the amount of martensite being formed. The steel is thereafter annealed in air at one or more temperatures where austenite areas not yet transformed to ausferrite, but having carbon contents intermediate between the initial medium carbon austenite and the films of austenite stabilized by high carbon content in ausferritic areas, will transform to new ausferritic areas having a microstructure similar to ausferrite formed isothermally at same temperature after quench. Concurrently any martensite formed earlier will be tempered and contribute to the strength of the ausferritic steel.

This method results in the cost-efficient production of one or more continuously cooled and annealed cast steel components or of one or more hot-worked semi-finished steel products having an ausferritic microstructure, i.e. the steel microstructure is mainly, if not completely, ausferritic. A mainly ausferritic microstructure is intended to mean that the steel contains at least 50% of ausferrite, at least 60% of ausferrite, at least 70% of ausferrite, at least 80% of ausferrite, and typically at least 90% of ausferrite.

The microstructure may also, if the hardenability of the alloy is insufficient for the cooling rate above the austempering temperature range, contain a small amount (2-8%) of proeutectoid ferrite and even lower amounts of pearlite, since the high silicon content delays cementite formation.

In addition, the microstructure may contain some martensite if the cooling rate through the austempering temperature range is too rapid due to small cross-sections, but such martensite will be tempered during the annealing at temperature.

It should be noted that the steel components do not necessarily need to be continuously cooled to ambient temperature before annealing is started, but annealing may start while the steel components are still at a temperature above the ambient temperature, thereby limiting or completely preventing any formation of martensite. There is also an option to increase the formation of martensite if the steel is cooled to temperatures lower than ambient temperature before annealing in order to increase the contribution to strength from martensite being tempered during the annealing.

The expression "semi-finished product" as used herein is intended to mean an intermediate product produced in a steel mill, namely a forging, rolled bar or rolled sheet, which needs further processing before being finished goods. The expression "semi-finished product" as used herein does not include rolled products such as strips that are sufficiently thin and flexible to form a coil without using excessive force.

The expression "continuously cooling from the fully austenitic temperature" as used herein is intended to mean that there is no quenching, i.e. there is no rapid cooling at rate of at least 30° C./second or at least 50° C./s or at least 70° C./s and no immersion in a quenching medium, such as a salt bath, and that there is no holding of temperature during the continuous cooling step before it reaches the intermediate temperature austempering range, but that the cast components or hot-worked semi-finished products are allowed to lose the residual heat from the casting or the hot-working process at a cooling rate that is initially sufficiently fast to prevent predominant formation of proeutectoid ferrite or pearlite, while subsequently at intermediate austempering temperatures, the cooling rate is sufficiently slow to allow a transformation of the austenite to mainly ausferrite during cooling.

To reduce the required alloying for hardenability in thicker sections in order to prevent predominant (i.e. at least 50%) formation of proeutectoid ferrite and/or pearlite, the cooling rate may be increased by fan cooling or water spray, but not by submerging into liquids.

When the cast components or hot-worked semi-finished products have reached intermediate temperatures where ausferrite is formed the cooling rate can be decreased in three ways, either by placing castings (within or without mould), forgings, rolled bars or rolled sheets close together (on the cooling bed for bars or sheets), by keeping castings in their moulds until they reach a lower temperature before shake-out and in the case of hot-worked semi-finished products by insulating them, or by placing the work pieces to cool in an oven held at a suitable austempering temperature in order to reduce their cooling rate until they reach the oven temperature.

The term "oven" as used in this document may be any device used for heating at least one part of one or more workpieces or maintaining at least one part of one or more workpieces at a particular temperature or within a particular temperature range. Workpieces may be placed entirely or partly within an oven. Alternatively, an "oven" may comprise one or more heating means placed adjacently to, along, or around one or more workpieces in order to heat at least one part of the one or more workpieces to a particular temperature or to maintain at least one part of the one or more workpieces at a particular temperature or within a particular temperature range.

If the time in the austempering temperature range during continuous cooling is too short for the austenite to transform completely into ausferrite, the remaining austenite areas will either transform to thermally induced martensite during cooling to ambient temperature making the steel brittle, or when mechanically loaded firstly cause an early plastic deformation in untransformed austenite areas resulting in low yield strength, and secondly fracture early with low ultimate tensile strength at low elongation when the deformed austenite transforms at by far too low strains into mechanically induced brittle martensite.

These limitations in mechanical properties can be eliminated by cost-effective annealing at temperatures within the austempering temperature range. During annealing the austenite areas having intermediate carbon content will continue to transform to ausferritic microstructures, being in fineness and ferrite-austenite proportions similar to ausferrite formed isothermally at same temperature after quench during conventional austempering. The resulting steel microstructure will consist of mainly two ausferritic morphologies, one formed during continuous cooling with varying fineness and ferrite-austenite proportions, the other with morphology governed by temperature vs. time during annealing, either isothermal or not.

The invention is based on the finding that it is possible to cost efficiently obtain mainly ausferritic steel in a continuously cooled and annealed cast component or hot-worked semi-finished product in steels having a silicon content of 1.5 to 4.4 weight percent and a carbon content of 0.3 to 0.8 weight percent, with alloying additions when necessary for sufficient hardenability in larger cross sections.

Surprisingly, it was found that the conversion to mainly ausferrite was able to be sufficiently transformed during the continuous cooling in air and then completed during annealing despite the high alloying content, which a skilled person would have expected to delay the conversion. No subsequent additional austempering heat treatment comprising quench followed by isothermal transformation in salt bath is therefore necessary to produce austempered steels, which may result in considerable savings in energy, time and cost.

Furthermore, austempered steel can be produced in continuous processes instead of batch processes. Current equipment for quenching followed by isothermal austempering in salt baths limit the length of heat treated parts to one or maximum two meters, while continuous cooling after hot rolling of bars followed by annealing in a belt oven enables production of ausferritic bars in delivery lengths exceeding 20 meters directly from rolling mills.

According to an embodiment of the invention the austempered steel has a microstructure that is substantially carbide-free or that contains very small volume fractions of carbides, i.e. less than 1 volume percent of carbides.

According to an embodiment of the invention the austempered steel has a Vickers hardness in the range of 380-550 HV, depending on its mixture (varying in different locations) of coarser ausferrite with more carbon stabilized austenite that is formed earlier at higher austempering temperatures, and finer ausferrite with more acicular ferrite that is formed later at lower austempering temperatures and/or during subsequent annealing at low temperatures, as described in detail later.

According to an embodiment of the invention the austempered steel has the following composition in weight percent:

| | |
|---|---|
| C | 0.3-0.8 |
| Si | 1.5-4.4 |
| Mn | 0-2.0 |
| Cr | 0-2.0 |
| Cu | 0-0.4 |
| Ni | 0-3.5 |
| Al | 0-1.0 |
| Mo | 0-0.5 |
| V | 0-0.5 |
| Nb | 0-0.2 |

balance Fe and normally occurring impurities. Phosphorous and sulphur are preferably kept to a minimum, whereby the maximum amount(s) of one or more of the optional alloying elements may be combined with any amount of silicon and any amount of carbon given in this document.

The method according to the present invention is namely suitable for the production of an austempered steel having any suitable chemical composition. Preferred compositions have high silicon contents i.e. a silicon content of 3.1 weight percent to 4.4 weight percent and intermediate carbon contents, i.e. a carbon content of 0.4 weight percent to 0.6 weight percent, irrespective of the amounts of the other alloying elements as long as the maximum values above are not exceeded.

According to an embodiment of the invention the preferred austempered steel has a silicon content of at least 1.6, 1.7, 1.8, 1.9, 2.0, 2.1, 2.2, 2.3, 2.4, 2.5, 2.6, 2.7, 2.8, 2.9, 3.0, 3.1, 3.2, 3.3, 3.4, 3.5, 3.6, 3.7, 3.8, 3.9 or 4.0 weight percent and/or a carbon content of at least 0.4 or 0.5 weight percent.

Additionally or alternatively, the preferred austempered steel that has a maximum silicon content of 4.3, 4.2, 4.1, 4.0, 3.9, 3.8, 3.7, 3.6 or 3.5 weight percent and/or a maximum carbon content of 0.6 or 0.5 weight percent.

According to an embodiment of the invention the preferred austempered steel has a maximum manganese content of 1.9, 1.8, 1.7, 1.6, 1.5, 1.4, 1.3, 1.2, 1.1, 1.0, 0.9, 0.8, 0.7, 0.6, 0.5, 0.4, 0.3, 0.2 or 0.1 weight percent.

According to an embodiment of the invention the preferred austempered steel has a maximum chromium content of 1.9, 1.8, 1.7, 1.6, 1.5, 1.4, 1.3, 1.2, 1.1, 1.0, 0.9, 0.8, 0.7, 0.6, 0.5, 0.4, 0.3, 0.2 or 0.1 weight percent.

According to an embodiment of the invention the preferred austempered steel has a maximum copper content of 0.3, 0.2 or 0.1 weight percent.

According to an embodiment of the invention the preferred austempered steel has a maximum nickel content of 3.4, 3.3, 3.2, 3.1, 3.0, 2.9, 2.8, 2.7, 2.6, 2.5, 2.4, 2.3, 2.2, 2.1, 2.0, 1.9. 1.8, 1.7, 1.6, 1.5, 1.4, 1.3, 1.2, 1.1, 1.0, 0.9, 0.8, 0.7, 0.6, 0.5, 0.4, 0.3, 0.2 or 0.1 weight percent.

According to an embodiment of the invention the preferred austempered steel has a maximum aluminium content of 0.9, 0.8, 0.7, 0.6, 0.5, 0.4, 0.3, 0.2 or 0.1 weight percent.

According to an embodiment of the invention the preferred austempered steel has a maximum molybdenum content of 0.4, 0.3, 0.2 or 0.1 weight percent.

According to an embodiment of the invention the preferred austempered steel has a maximum vanadium content of 0.4, 0.3, 0.2, or 0.1 weight percent.

According to an embodiment of the invention the preferred austempered steel has a maximum niobium content of 0.1 weight percent.

The word "max" throughout this document is intended to mean that the steel comprises from 0 weight percent (i.e. including 0 weight percent) up to and including the indicated maximum amount of the element in question. The produced austempered steel may therefore comprise low levels of such elements when not needed for hardenability or other reasons, i.e. levels of 0 to 0.1 weight percent. The produced austempered steel may however comprise higher levels of at least one or any number of these elements for optimizing the process and/or final properties, i.e. levels including the indicated max amount or levels approaching the indicated max amount to within 0.1, 0.2 or 0.3 weight percent.

It will be appreciated that the austempered steel may contain unavoidable impurities, although, in total, these are unlikely to exceed 0.5 weight percent of the composition, preferably not more than 0.3 weight percent of the composition, and more preferably not more than 0.1 weight percent of the composition. The austempered steel alloy may 30 consist essentially of the recited elements. It will therefore be appreciated that in addition to those elements that are mandatory, other non-specified elements may be present in the composition provided that the essential characteristics of the composition are not substantially affected by their presence.

The mainly ausferritic microstructure that forms when subjecting a steel alloy having a preferred silicon content of 3.1 to 4.4 weight percent and a preferred carbon content of 0.4 to 0.6 weight percent to a continuous cooling through the austempering temperature range from the fully austenitic temperature after either casting of a steel component, or hot forging or hot rolling of a semi-finished steel product, is namely a mixture of coarser ausferrite with more austenite that is formed earlier at higher austempering temperatures, and finer ausferrite with more ferrite that is formed later at lower austempering temperatures, i.e. temperatures closer to the initial $M_s$ temperature.

Such a mixed mainly ausferritic microstructure is less uniform than the microstructure that is formed isothermally after quenching into a salt bath during a conventional austempering heat treatment. The microstructure in a continuously cooled austempered cast steel component, hot forged or hot rolled semi-finished steel product therefore varies with both cross-section and position between surface and thermal center, since different parts will have different cooling rates within the intermediate temperature range below the proeutectoid ferrite/pearlite region in the continuous cooling transformation (CCT) diagram but above the initial $M_s$ temperature. However, the subsequent annealing leads, in comparison to ausferrite formed during continuous cooling only, to a complete transformation of any remaining austenite areas of intermediate carbon content into ausferrite, resulting in a more robust process providing superior and less varying mechanical properties.

Furthermore, in contrast to isothermal formation after quenching, the microstructure formed during continuous cooling may, if the hardenability of the alloy is insufficient for the cooling rate above the austempering temperature range, contain a small amount (2-8%) of proeutectoid ferrite but even lower amounts of pearlite, since the high silicon content delays cementite formation.

The inventor has found that ausferritic steels having preferred high silicon contents of 3.1 to 4.4 weight percent and preferred intermediate carbon contents of 0.4 to 0.6 weight percent, when completely austenitized at sufficiently high temperatures (depending on silicon content), have several advantages over prior ausferritic steels (having silicon contents less than 3.0 weight percent and having carbon contents greater than 0.6 weight percent). There are namely improvements in both heat treatment performance and resulting mechanical properties of the ausferritic steel.

For example, such austempered steels can concurrently exhibit tensile strengths of at least 1000 MPa, at least 1100 MPa, at least 1200 MPa, at least 1300 MPa, at least 1400 MPa, at least 1500 MPa, at least 1600 MPa, at least 1700 MPa, at least 1800 MPa, at least 1900 MPa, or at least 2000 MPa, fracture elongations of at least 8%, at least 10%, at least 12%, at least 14%, at least 16%, at least 18%, or at least 20%, and fracture toughness $K_{JIC}$ of at least 80 MPa√m, at least 100 MPa√m, or at least 150 MPa√m.

Due to the promotion by silicon of ferrite precipitation and growth, the time required for austempering is reduced also for austempered steels with a preferred intermediate carbon content of 0.4 weight percent to 0.6 weight percent, especially at low transformation temperatures close above the initial $M_s$ temperature.

Additionally, the preferred high silicon content of 3.1 weight percent to 4.4 weight percent together with the preferred intermediate carbon content of 0.4 weight percent to 0.6 weight percent will ensure that carbide precipitation can be avoided, not only in relatively coarse ausferrite (formed at higher austempering temperatures) with a larger amount of carbon stabilized austenite but also avoided in finer ausferrite (formed at low austempering temperatures close to initial $M_s$) with a smaller amount of carbon stabilized austenite.

Furthermore, the high silicon content also results in increased solid solution strengthening of the acicular ferrite formed, both substitutionally by silicon and interstitially by carbon (since the lattice of this ferrite is slightly tetragonal, although less so than in martensite).

The continuously cooled and annealed cast ausferritic steel component, hot forged or hot rolled semi-finished ausferritic steel product produced using a method according to the present invention may be further processed to make finished goods for use particularly, but not exclusively, in mining, construction, agriculture, earth moving, manufacturing industries, the railroad industry, the automobile industry, the forestry industry, metal producing, automotive, energy and marine applications, or in any other application which requires concurrently very high levels of tensile strength and ductility and/or fracture toughness and/or increased fatigue strength and/or high wear resistance, such as an application for which neither quenched and tempered martensitic nor austempered bainitic steels have sufficient properties, or in applications in which strict specifications must be met consistently. The ausferritic steel may for example be used in a suspension or powertrain-related component for use in a heavy goods vehicle or to manufacture components such as springs, spring hangers, brackets, wheel hubs, brake callipers, cams, camshafts, annular gears, clutch collars, bearings, pulleys, fastening elements, gears, gear teeth, splines, high strength steel components, load-bearing structures, armour, and/or components that must be less sensitive to hydrogen embrittlement.

BRIEF DESCRIPTION OF THE DRAWINGS

The present invention will hereinafter be further explained by means of non-limiting examples with reference to the appended figure where.

Curves #1 and #3 with their mechanical properties in this figure correspond to microstructures shown in FIGS. 2-5.*a* and 2-5.*b*, respectively.

DETAILED DESCRIPTION OF EMBODIMENTS

Figure 1:
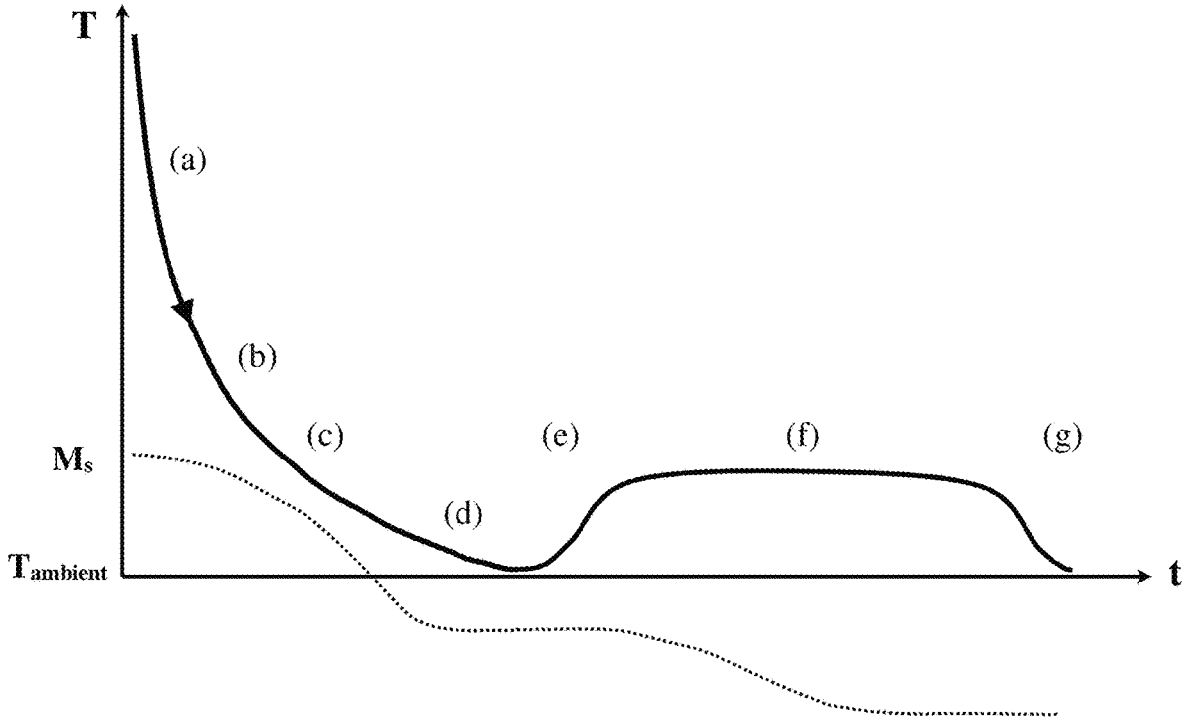
FIG. 1 schematically shows the steps of a method for producing an austempered steel during continuous cooling followed by annealing according to an embodiment of the invention. The dashed $M_s$ line schematically illustrates that during formation of ausferrite, the nucleation and growth of acicular ferrite enriches the surrounding austenite with carbon, thus reducing its $M_s$ temperature during both continuous cooling and during annealing.

FIG. 1 shows the steps of a method for producing an ausferritic steel according to an embodiment of the invention.

The method comprises the steps of: (a) continuous cooling from an austenitic state passing the pearlite nose; (b) entering into the austempering intermediate temperature range during cooling; (c) nucleation and growth of acicular ferrite and carbon enriching of austenite with reducing $M_s$; (d) incomplete transformation into ausferrite stops before cooling to ambient temperature; (e) heating to an annealing temperature; (f) completing the transformation to ausferrite with stabilized austenite having further reduced $M_s$; (g) cooling to ambient temperature.

The method comprises the step of subjecting a steel alloy having a preferred silicon content of 3.1 to 4.4 weight percent and a preferred carbon content of 0.4 to 0.6 weight percent to either casting of a steel component, or hot forging or hot rolling of a semi-finished steel product.

After either casting of one or more steel components, or hot-working, i.e. hot forging or hot rolling of one or more semi-finished steel products, during which the one or more steel components or semi-finished steel products reach the fully austenitic temperature, the one or more steel components or semi-finished steel products is/are then continuously cooled from the fully austenitic temperature followed by annealing at one or more temperatures to produce one or more continuously cooled and annealed ausferritic steel components or semi-finished steel products. A hot-worked semi-finished product may be continuously cooled on a cooling bed, such as on the cooling bed of a hot-rolling mill for example, and subsequently annealed, in a belt oven or a batch oven for example.

The cooling rate can, especially further down in the austempering temperature range, be decreased (but not prevented) by insulation, such as in the case of a cast component by keeping the cast component in the mould until it has reached a lower temperature before shake-out or even by insulating the mould by covering with a thermally insulating material, such as a blanket comprising refractory ceramic fibre (RCF) or high-temperature insulating wool (HTIW), and in the case of a hot-worked semi-finished product, a plurality of semi-finished hot-worked products may be stacked or placed adjacently to one another during the continuous cooling step and/or even insulated by covering them with a thermally insulating material, such as a blanket comprising refractory ceramic fibre (RCF) or high-temperature insulating wool (HTIW).

The cast steel component, hot forged or hot rolled semi-finished product may be continuously cooled by natural cooling, forced cooling (but not quenching) or delayed cooling in an ambient atmosphere such as air. The continuous cooling may either reach asymptotically one or more temperatures for isothermal treatments, for example by cooling slower in an oven, or continue down to ambient temperature, or be cooled further to lower temperature to deliberately form some amount of martensite.

If cooled to ambient temperature or lower, the steel is thereafter heated and annealed at one or several low austempering temperatures where austenite areas not yet transformed to ausferrite, but having carbon contents intermediate between the initial medium carbon austenite and the films of carbon stabilized austenite in ausferritic areas, will transform to new ausferritic areas having a microstructure similar to ausferrite formed isothermally at same temperature after quench. Concurrently any amount of martensite formed at earlier stages will be tempered and contribute to the strength of the austempered steel.

The method according to the present invention results in the production of austempered steel that has a predominantly ausferritic microstructure. An ausferritic structure is well known and can be determined by conventional microstructural characterization techniques such as, for example, at least one of the following: Optical microscopy, transmission electron microscopy (TEM), scanning electron microscopy (SEM), Atom Probe Field Ion Microscopy (AP-FIM), and X-ray diffraction.

According to an embodiment of the invention the microstructure of the ausferritic steel is substantially carbide-free, or contains less than 1 vol-% of carbides.

EXAMPLE 1

Austempered steel having the following composition in weight percent was produced using a method according to an embodiment of the present invention:

| | |
|---|---|
| C | 0.5 |
| Si | 3.3 |
| Mn | 0.5 |
| Cr | 0.3 |
| Cu | 0.2 |
| Ni | 1.6 |
| Mo | 0.2 |
| V | 0.3 |

balance Fe and normally occurring impurities, such as 0.012 weight percent P and 0.006 weight percent S.

A 1400 kg rolling ingot having the chemical composition described above was cast vertically in a permanent cast iron mould having an internal height of 1690 mm, top and bottom sections having the dimensions 255×230 mm and 440×350 mm respectively and a conicity of 6.3°×4.1°.

The ingot was subsequently forged into a rolling billet 165×165×4560 mm. Thereafter the billet was hot rolled into round bar having a diameter of Ø53 mm. The cast and forged billet was namely preheated in a furnace at a temperature of 1200° C. for two hours, rough rolled three times and then rolled continuously to a final bar diameter of Ø53 mm. After hot rolling finished at 1040° C., the Ø53 mm round bar was transferred to a walking beam cooling bed next to Ø53 mm round bars previously hot rolled and left to cool continuously during 18 minutes to 460° C., whereafter the bar was cut into 6 m lengths. A few minutes later the resulting nine bars from this billet were bundled together, followed by further air cooling to ambient temperature.

The average cooling rate at 700° C. in Ø53 mm round bars is about 0.7° C./s in still air, but due to the surrounding hot rolled bars at the cooling bed (and no cooling fans) the actual mean cooling rate was 0.5° C./s. This cooling rate resulted in about 2-3% of proeutectoid ferrite formed near the bar surface and about 8-10% of proeutectoid ferrite in the center, while only occasional small areas of pearlite nucleated on the proeutectoid ferrite, since the high silicon content delays cementite formation. These microstructures indicate that the alloy had in this case a slightly too low hardenability for this cooling rate to result in ausferrite only, but if the bar dimension had been smaller and/or the cooling rate around 700° C. had been increased by cooling fans or water spray, the austenite would have been completely preserved for transformations to ausferrite at lower temperatures.

The continuously cooled hot-worked semi-finished austempered Ø53 mm round steel bar had a Vickers hardness of 412±4.7 HV30, where the variations in hardness are mainly reflecting the difference in minor amounts of proeutectoid ferrite as earlier described. This hardness level can be compared with 369±5.2 HV30 in the previously cast and forged mainly pearlitic rolling billet.

When the continuously cooled austempered bar was studied by microscopy, it was found that the mainly ausferritic microstructure (with small amounts of proeutectoid ferrite) also contained some austenitic areas being much thicker than the mainly submicron austenite films within ausferrite. From earlier experiences during development of SiSSADI™ it was concluded that although these austenite areas had been enriched with carbon sufficiently to avoid their transformation to martensite during cooling to ambient temperature (by decreasing $M_s$ temperature below ambient), these areas had not been able to transform completely into ausferrite during the short time within the austempering temperature range during continuous cooling, probably due to compositional variations from segregation since enrichment of carbon and some of the substitutional alloying elements are known to delay the otherwise surprisingly rapid transformation into ausferrite in high silicon medium carbon steels.

Initial mechanical tensile testing verified the conclusions from microstructural observation. The results were as follows: $R_{p0.2}$=820.5±7.8 MPa; $R_m$=1269±19 MPa; $A_5$=2.71±0.02%. In stark contrast to typical behaviors for fully ausferritic steels, fracture occurred far before necking, indicating the presence of areas of austenite being too low in carbon and too thick to resist their premature strain-induced transformation into martensite, before efficient strain hardening within the ausferritic microstructure has been able to increase plastic elongation and contraction before fracture.

To investigate if the unfinished transformation into ausferrite could be completed, tensile testing bars were subject to an annealing heat treatment at 250° C. for 6 h. This long duration at elevated temperature was permitted since the high silicon content in the steel (3.3% Si) efficiently stabilizes the already formed ausferrite by delaying/preventing any destructive transformation of its high carbon austenite films within the ausferrite into brittle bainite. The hardness of the steel increased by annealing from 412±4.7 HV30 to 431±3.5 HV30. Microstructural observation confirmed that the previous thicker austenitic areas having intermediate carbon content were during the annealing replaced with ausferrite, being much finer than most of the ausferrite earlier formed during continuous cooling (that was mainly nucleated and grown in the beginning of the cooling at higher temperatures when carbon diffusion is more rapid), thereby increasing the hardness.

Tensile testing verified also in this case the conclusions from microstructural observation. The results were as follows: $R_{p0.2}$=1118±3.5 MPa; $R_m$=1447±5 MPa; $A_5$=23.1±0.9%. Compared to the previous results, the yield strength was much higher, followed by efficient strain hardening within the ausferritic microstructure that resulted in a considerable isotropic plastic elongation up to 18% where an increased ultimate tensile strength was reached, followed by necking and considerable contraction (Z=26.5±0.6%) before fracture.

EXAMPLE 2

An alloy consisting of 0.45 wt % C, 3.33 wt % Si, 1.57 wt % Ni, 0.60 wt % Mn, 0.30 wt % V, 0.29 wt % Cr, 0.21 wt % Cu and 0.20 wt % Mo, was cast into a conical 1.4 tonne ingot with dimensions 1690×(440–255)×(350–230) mm. The ingot was then forged to a cross-section having an area of 165×165 mm, followed by hot-rolling to round bar having a diameter of Ø53 mm.

The surface temperature of the bar was 1010° C. when entering the cooling bed after rolling, and 18 minutes later the surface of the bar had cooled to 461° C., when it was cut/sheared into nine bars having a length of six meters and immediately bundled together for further handling. The cooling time after bundling within the temperature range 460-320° C. was estimated to be about 10 minutes, by using data from the Atlas of Continuous Cooling Transformation Diagrams of Engineering Steels, by M. Atkins, ASM and British Steel Corporation 1980.

Initial hardness testing surprisingly revealed a hardness level much higher than anticipated for a ferritic-pearlitic microstructure, in spite of the considerable substitutional solution hardening of its ferrite by Si and Ni. The first tensile tests of the as-rolled steel showed, however, only a few percent elongation at fracture for tensile strengths varying between 1040-1350 MPa.

Later metallographic work and low temperature annealing of the rolled bar in air revealed some astonishing effects on the mechanical properties which initiated a deeper investigation of the causes. Microstructures before and after annealing were investigated using light optical microscopy and fracture surfaces by SEM (JEOL IT300).

Finally the annealing treatment of the as-rolled bar was investigated for different combinations of temperature and time, followed by tensile testing (DARTEC M1000/RK) at room temperature according to EN ISO 6892-1:2016. The tensile testing bars were 120 mm long with 010 mm cylindrical parts between 022 mm heads. A 50 mm extensometer measured the $A_5$ elongation during a cross-head speed of 2 mm/min.

Figure 2:
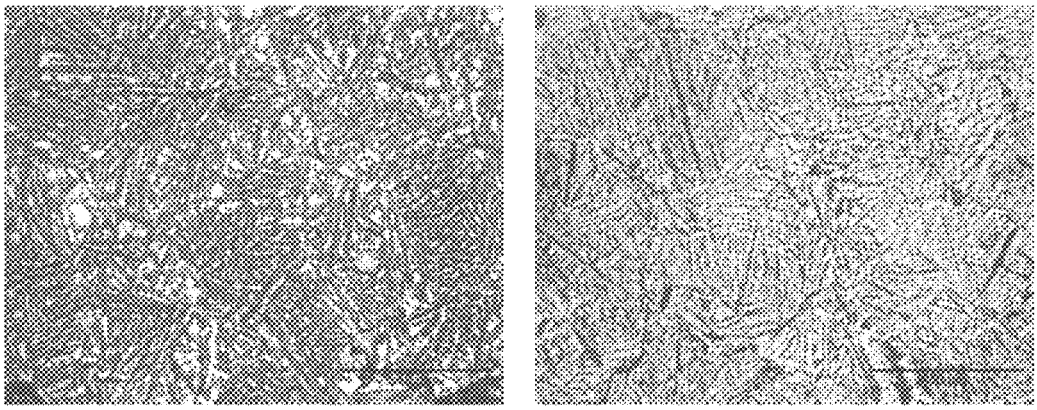
FIG. 2 shows the microstructure by light optical microscopy after Nital etching of Example 2 as rolled (a) and after rolling followed by annealing in air for 6 hours (b); the scale bar corresponds to 50 μm in both micrographs.

Conventional optical metallography after Nital etching revealed a predominantly ausferritic structure, although not fully developed, see FIG. 2.*a*. Remaining larger bright austenitic "islands" ("blocky" shape in contrast to "film" shape in ausferrite) are carbon enriched (since thermally stable at room temperature), but they have not reached their final carbon content or fine size.

In the core of the rolled Ø53 mm bar about 5% of proeutectoid ferrite (but no pearlite due to the high silicon content) could be seen, indicating that the hardenability of the steel alloy was slightly lower than required for the air cooling experienced for the Ø53 mm diameter steel bar on the cooling bed. After low temperature annealing in air for six hours at a temperature level 30 K below the initial $M_s$ temperature of the austenite, the bright austenite islands had been transformed into fine ausferrite, see FIG. 2.*b*.

Figure 3:
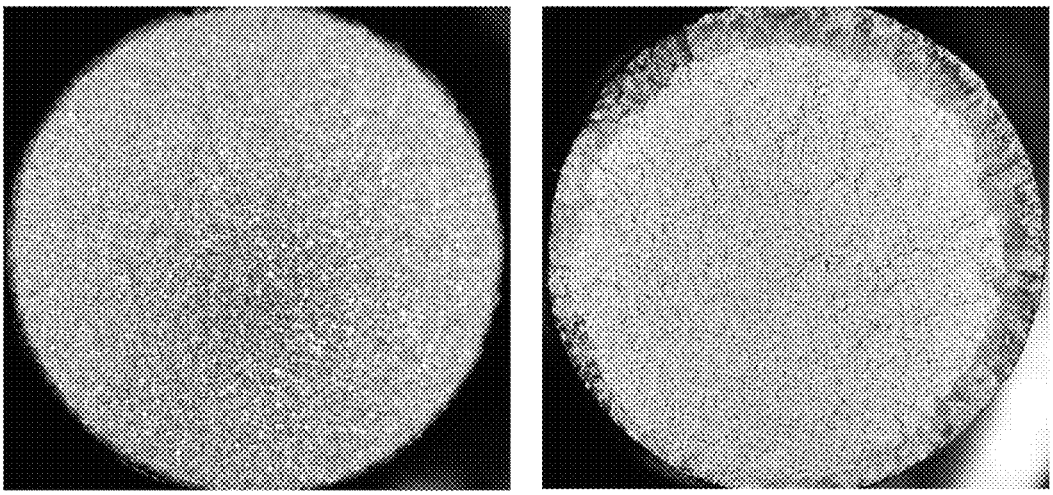
FIG. 3 shows the fracture surfaces by light optical microscopy of the complete tensile bar cross-sections initially 010.0 mm of Example 2 as rolled (a) and same steel after rolling followed by annealing in air for 6 hours (b)
Figure 4:
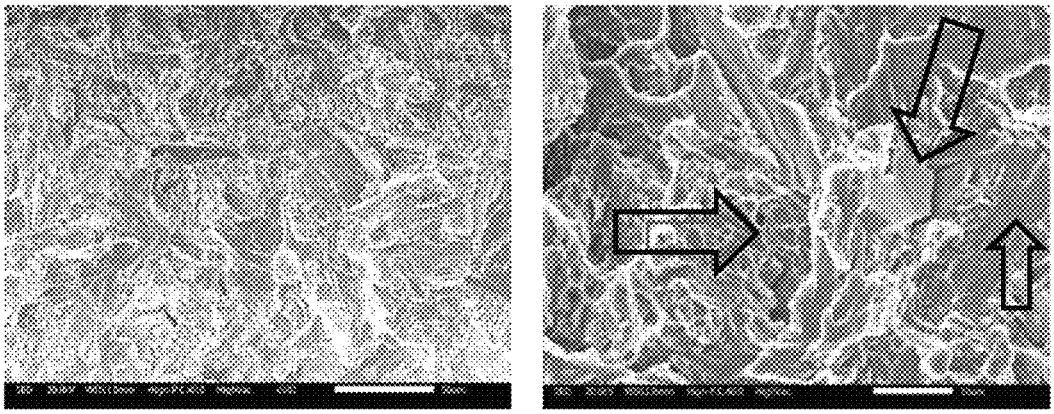
FIG. 4-5 show the fracture surfaces by scanning electron microscopy of Example 2 as rolled (a) and same steel after rolling followed by annealing in air for 6 hours (b); scale bars correspond to 50 μm in FIGS. 4*a* and 5*a*, and 10 μm in FIGS. 4*b* and 5*b*.
Figure 5:
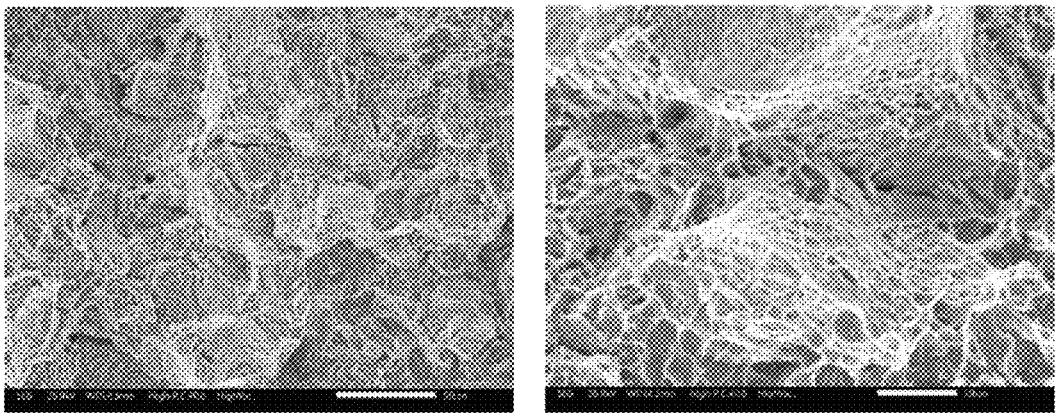

FIGS. 3-5 show fracture surfaces from tensile testing bars. The stereo microscope photos show small "mirrors" in the as-rolled fracture (see FIG. 3.*a*) and shear lips after necking before fracture in the annealed sample (see FIG. 3.*b*).

At higher magnification in SEM the as-rolled fracture is dominated by ductile dimple areas but does also contain probably weakening areas (corresponding to the bright austenitic islands in FIG. 2.*a*) of quasi-brittle fracture mixed with cleavage fracture, see SEM micrographs in FIG. 4. At the higher magnification in FIG. 4.*b*, the different types of fracture are indicated by arrows: The arrow in the middle for cleavage, the arrow on the right hand-side for quasi-brittle and the arrow on the left hand side for ductile dimples.

After annealing for 6 hours at a temperature level 30 K below the initial $M_s$ temperature of the austenite before entering the cooling bed, the fracture becomes completely ductile, see FIG. 5.

Figure 6:
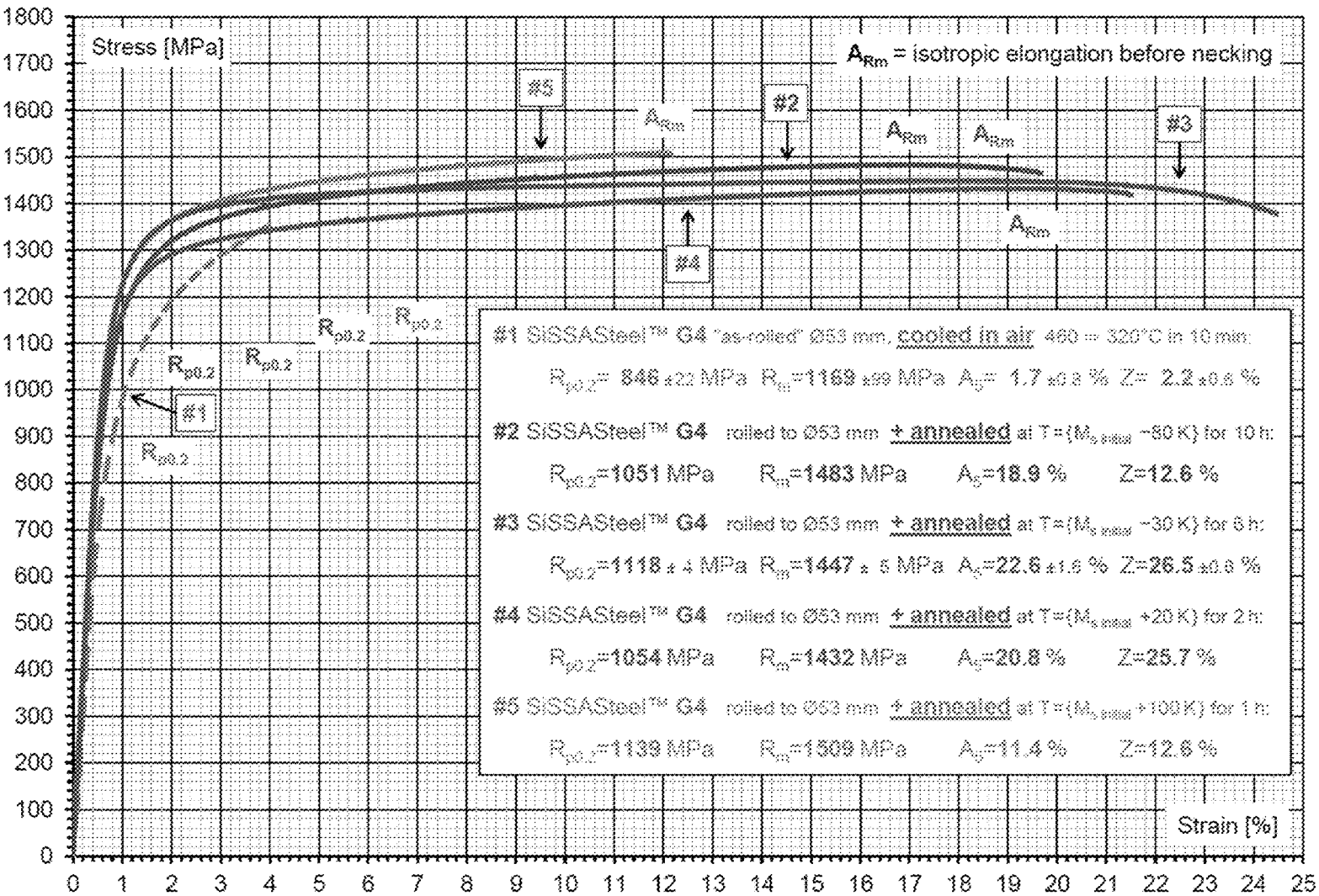
FIG. 6 shows stress-strain curves and mechanical properties for as-rolled (curve #1 and the first two rows in the legend) versus rolled and annealed steels using four different combinations of annealing temperature and annealing time (curves #2-5 and corresponding rows 3-10 in the legend).

The stress-strain curves and resulting mechanical properties are presented in FIG. 6, together with three additional different combinations of annealing temperature and annealing time after rolling of the same steel.

The as-rolled steel in curve #1 (see mechanical properties presented in row 2 in the legend) yielded early, presumably due to plastic deformation in the softer austenite islands, followed by fracture occurring far before necking. This indicates the presence of austenite being too low in carbon and too thick to resist premature strain-induced transformation into martensite, before the efficient strain hardening within the ausferritic microstructure has been able to increase plastic elongation and contraction before fracture. The scatter in properties was also high, especially for the ultimate tensile strength.

After annealing for 6 h at $T=\{M_{s\ initial}-30\ K\}$, the mechanical response became totally different, (see curve #3 and mechanical properties presented in row 6 in the legend). Both the yield strength $_{Rp0.2}$ and the ultimate tensile strength $R_m$ increased by about 275 MPa and with very low scatter (standard deviation±4-5 MPa). Furthermore the elongation was isotropic beyond 18% (to $R_m$) and finally ruptured at 23.7±2%.

Finally, the annealing treatment of the as-rolled bar was investigated for different combinations of temperature and time. Due to difficulties in cutting the as-rolled bar with its mechanically unstable austenite using a HSS band saw (thus requiring expensive sectioning with EDM), only single bars were evaluated (without determination of standard deviation for properties). Both a lower annealing temperature for longer time (see curve #2 and the resulting mechanical properties presented in row 4 in the legend) and two higher annealing temperatures for shorter times (see curves #4 and #5 with mechanical properties presented in row 8 and row 10 in the legend) give similar results, namely substantial improvements of both yield strength and ultimate tensile strength, concurrently with very high ductility.

The hardness of the ferritic-pearlitic forged ingot before rolling was 369±5 HV30. In the as-rolled Ø53 mm bar the hardness in the predominantly ausferritic microstructure formed during continuous cooling (with some less stable austenite islands remaining) increased 35 to 415±5 HV30.

In the Ø53 mm bar rolled+annealed for 6 h at $T=\{M_{s\ initial}-30\ K\}$ the hardness increased further to 431±4 HV30.

The small hardness increase during annealing corresponds well with microstructural observations that the as-rolled microstructure was already predominantly ausferritic. The very fine ausferrite subsequently formed during annealing can therefore only raise the hardness slightly, in spite of its high hardness being probably far above 500 HV, since the very fine ausferrite represents only a few volume percent.

This is also the reason why ausferrite formed at various temperatures (see FIG. 6) results in similar mechanical properties. If less ausferrite has time to form during the previous continuous cooling, the influence from annealing temperature would be larger.

To find out in which temperature range ausferrite was mainly formed during the continuous cooling of the hot rolled bar, a comparison was made with the same steel alloy after conventional austempering by complete austenitization followed by quenching and isothermal transformation in a salt bath held at $T=\{M_{s\ initial}+20\ K\}$. The resulting hardness of the isothermally formed ausferritic steel was 490±5 HV30.

Based on the inventor's experience of hardness dependence on isothermal transformation temperature, this implies that the as-rolled ausferrite structure established but not completed during continuous cooling would correspond to a far higher salt bath temperature of $T=\{M_{s\ initial}+95\ K\}$. Furthermore, the strength levels of ausferritic steels isothermally transformed at such high salt bath temperatures are similar to levels in these rolled+annealed steels, in which mechanically unstable austenite areas have been eliminated.

The advantages offered by the method for producing ausferritic steels according to the present invention can be summarized as follows:

Quenching followed by isothermal transformation in salt baths are not necessary, on condition that the cooling rate of the steel around the eutectoid temperature is sufficiently rapid relative to the hardenability of the alloy to preserve most of the austenite for consecutive transformation to predominantly ausferrite during continuous cooling within the austempering temperature range.

Continuous cooling in air (instead of quenching in liquids) followed by annealing at low temperatures reduces both residual stresses and production costs, while enabling very strong, ductile and tough ausferritic steels to be delivered in lengths exceeding 20 meters directly from rolling mills combined with low temperature belt ovens.

The annealing is able to complete the transformation of austenite to predominantly ausferrite, on condition that carbon diffusion during the previous continuous cooling has sufficiently stabilized the remaining larger areas of austenite against transformation to more than minor amounts of martensite if cooled to ambient temperature, or cooled further to deliberately form martensite before annealing, where the transformation into ausferrite is completed concurrently with low-temperature tempering of any martensite, avoiding temper embrittlement in this temperature range due to the high silicon content.

The annealing thus reduces the need to decrease cooling rates within the austempering temperature range in order to complete the transformation into ausferrite within current production processes such as casting, forging and rolling, while the subsequent annealing at low temperature in air in batch ovens or belt ovens may result in extremely good mechanical properties with small scatter.

If martensite is formed during the continuous cooling to ambient temperature or deliberately lower temperatures it becomes tempered during the annealing, thus contributing to even higher strength of the predominantly ausferritic steel.

Further modifications of the invention within the scope of the claims would be apparent to a skilled person. For example, it should be noted that any feature or method step, or combination of features or method steps, described with reference to a particular embodiment of the present invention may be incorporated into any other embodiment of the present invention.

The invention claimed is:

1. A method for producing an austempered steel, comprising:

subjecting a steel alloy that has the following composition in weight percent:

| | |
|---|---|
| C | 0.3-0.8 |
| Si | 1.5-4.4 |

-continued

| | |
|---|---|
| Mn | 0-2.0 |
| Cr | 0-2.0 |
| Cu | 0-0.4 |
| Ni | 0-3.5 |
| Al | 0-1.0 |
| Mo | 0-0.5 |
| V | 0-0.5 |
| Nb | 0-0.2 |

balance Fe and normally occurring impurities, to casting one or more steel components, or hot forging or hot rolling one or more semi-finished steel products;

continuous cooling without quenching; and annealing, wherein the continuous cooling begins at a fully austenitic temperature, wherein the cooling rate during the continuous cooling is initially sufficient to result in less than 50% of proeutectoid ferrite and pearlite, wherein the continuous cooling subsequently includes an intermediate temperature range below the proeutectoid ferrite/pearlite region in a continuous cooling transformation (CCT) diagram but above the initial $M_s$ temperature, wherein in the intermediate temperature range, the cooling rate is sufficient to allow a transformation of austenite to at least 50% of ausferrite during cooling, wherein the transformation of austenite to at least 50% of ausferrite occurs before any carbon enriched austenite has reached a temperature below its $M_s$ temperature, thereby limiting the amount of martensite being formed, and wherein the annealing, which is carried out after the continuous cooling, completes the transformation of carbon enriched austenite to ausferrite and tempers any martensite previously formed, the method resulting in production of one or more continuously cooled and annealed austempered components or semi-finished products, whereby the austempered steel contains at least 50% of ausferrite.

2. The method according to claim 1, wherein the continuous cooling comprises cooling naturally in air and/or accelerated cooling and/or decelerated cooling in different temperature ranges.

3. The method according to claim 1, wherein the austempered steel has a microstructure that contains less than 10 volume percent of proeutectoid ferrite.

4. The method according to claim 1, wherein the austempered steel has a microstructure that contains less than 40 volume percent of tempered martensite.

5. The method according to claim 1, wherein the austempered steel has a microstructure that contains less than 1 volume percent of carbides.

6. The method according to claim 1, wherein the austempered steel has a silicon content of 3.1 to 4.4 weight percent and a carbon content of 0.4 to 0.6 weight percent.

* * * * *